US010451282B2

(12) United States Patent
Benjamin et al.

(10) Patent No.: US 10,451,282 B2
(45) **Date of Patent: *Oct. 22, 2019**

(54) FUEL NOZZLE STRUCTURE FOR AIR ASSIST INJECTION

(71) Applicant: GENERAL ELECTRIC COMPANY, Schenectady, NY (US)

(72) Inventors: Michael Anthony Benjamin, Cincinnati, OH (US); Joshua Tyler Mook, Loveland, OH (US); Sean James Henderson, Bellbrook, OH (US); Ramon Martinez, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 142 days.

This patent is subject to a terminal disclaimer.

(21) Appl. No.: 15/107,282

(22) PCT Filed: Dec. 23, 2014

(86) PCT No.: PCT/US2014/072023

§ 371 (c)(1),
(2) Date: Jun. 22, 2016

(87) PCT Pub. No.: WO2015/147934

PCT Pub. Date: Oct. 1, 2015

(65) Prior Publication Data

US 2017/0003030 A1 Jan. 5, 2017

Related U.S. Application Data

(60) Provisional application No. 61/920,002, filed on Dec. 23, 2013.

(51) Int. Cl.
*F23R 3/28* (2006.01)
*F23R 3/34* (2006.01)
(Continued)

(52) U.S. Cl.
CPC ..... *F23R 3/283* (2013.01); *F23D 11/386* (2013.01); *F23R 3/286* (2013.01);
(Continued)

(58) Field of Classification Search
CPC ..... F23R 3/283; F23R 3/286; F23R 3/343; F23R 2900/00004; F23D 2209/30
See application file for complete search history.

(56) References Cited

U.S. PATENT DOCUMENTS 1,908,066 A 5/1933 Sedlmeir
3,258,838 A 7/1966 Tilton
(Continued)

FOREIGN PATENT DOCUMENTS

CN 101025167 A 8/2007
CN 101900340 A 12/2010
(Continued)

OTHER PUBLICATIONS

First Office Action and Search issued in connection with corresponding CN Application No. 201480070681.7 dated Mar. 24, 2017.

(Continued)

*Primary Examiner* — Gerald L Sung
*Assistant Examiner* — Stephanie Cheng
(74) *Attorney, Agent, or Firm* — General Electric; Pamela Kachur

(57) ABSTRACT

A fuel nozzle includes an outer body extending parallel to a centerline axis, having a generally cylindrical exterior surface, forward and aft ends, and a plurality of openings through the exterior surface. The fuel nozzle further includes an inner body inside the outer body, cooperating with the outer body to define an annular space, and a main injection ring inside the annular space, the main injection ring including fuel posts extending therefrom. Each fuel post is aligned
(Continued)

with one of the openings and separated from the opening by a perimeter gap which communicates with the annular space. There is a circumferential main fuel gallery in the main injection ring, and a plurality of main fuel orifices, wherein each orifice communicates with the main fuel gallery and extends through one of the fuel posts.

8 Claims, 4 Drawing Sheets

(51) Int. Cl.
*F23R 3/14* (2006.01)
*F23D 11/38* (2006.01)

(52) U.S. Cl.
CPC ..... *F23D 2209/30* (2013.01); *F23R 3/14* (2013.01); *F23R 3/34* (2013.01); *F23R 3/346* (2013.01); *F23R 2900/00004* (2013.01)

(56) References Cited

U.S. PATENT DOCUMENTS 3,291,191 A 12/1966 Stoops
3,480,416 A 11/1969 Stoops et al.
3,656,222 A 4/1972 Jones
3,672,032 A 6/1972 Witherspoon
3,684,186 A 8/1972 Helmrich
3,707,750 A 1/1973 Klass
3,837,198 A 9/1974 Higgins
3,909,157 A 9/1975 Wachtell et al.
4,085,717 A 4/1978 Willmann et al.
4,088,437 A 5/1978 Holzapfel
4,216,652 A 8/1980 Herman
4,247,259 A 1/1981 Saboe et al.
4,273,070 A 6/1981 Hoefelmayr
4,327,547 A 5/1982 Hughes et al.
4,425,755 A 1/1984 Hughes
4,461,323 A 7/1984 Morikawa et al.
4,582,093 A 4/1986 Hubbard et al.
4,584,834 A 4/1986 Koshoffer et al.
4,609,150 A 9/1986 Pane, Jr. et al.
4,610,320 A 9/1986 Beakley
4,674,167 A 6/1987 Hubbard et al.
4,722,559 A 2/1988 Bongartz
4,798,330 A 1/1989 Mancini et al.
4,969,110 A 11/1990 Little et al.
5,038,014 A 8/1991 Pratt et al.
5,057,073 A 10/1991 Martin
5,062,205 A 11/1991 Fraser
5,097,666 A 3/1992 Shekleton et al.
5,117,637 A 6/1992 Howell et al.
5,197,191 A 3/1993 Dunkman et al.
5,220,786 A 6/1993 Campbell
5,270,926 A 12/1993 Tam
5,297,215 A 3/1994 Yamagishi
5,309,709 A 5/1994 Cederwall et al.
5,321,947 A 6/1994 Sood et al.
5,321,951 A 6/1994 Falls et al.
5,329,761 A 7/1994 Ablett et al.
5,460,758 A 10/1995 Langer et al.
5,474,419 A 12/1995 Reluzco et al.
5,501,840 A 3/1996 Mantovani
5,673,552 A 10/1997 Idleman et al.
5,713,205 A 2/1998 Sciocchetti et al.
5,715,167 A 2/1998 Gupta et al.
5,761,907 A 6/1998 Pelletier et al.
5,794,601 A 8/1998 Pantone
5,824,250 A 10/1998 Whalen et al.
5,836,163 A 11/1998 Lockyer
5,916,142 A 6/1999 Snyder et al.
5,963,314 A 10/1999 Worster et al.
5,988,531 A 11/1999 Maden et al.
5,993,731 A 11/1999 Jech et al.
6,003,756 A 12/1999 Rhodes
6,032,457 A 3/2000 McKinney et al.
6,041,132 A 3/2000 Isaacs et al.
6,068,330 A 5/2000 Kasuga et al.
6,134,780 A 10/2000 Coughlan et al.
6,144,008 A 11/2000 Rabinovich
6,227,801 B1 5/2001 Liu
6,256,995 B1 7/2001 Sampath et al.
6,269,540 B1 8/2001 Islam et al.
6,283,162 B1 9/2001 Butler
6,354,072 B1 3/2002 Hura
6,355,086 B2 3/2002 Brown et al.
6,363,726 B1 4/2002 Durbin et al.
6,367,262 B1 4/2002 Mongia et al.
6,381,964 B1 5/2002 Pritchard, Jr. et al.
6,389,815 B1 5/2002 Hura et al.
6,391,251 B1 5/2002 Keicher et al.
6,405,095 B1 6/2002 Jang et al.
6,418,726 B1 7/2002 Foust et al.
6,419,446 B1 7/2002 Kvasnak et al.
6,442,940 B1 9/2002 Young et al.
6,453,660 B1 * 9/2002 Johnson ..... F23C 99/00 60/39.821
6,460,340 B1 10/2002 Chauvette et al.
6,461,107 B1 10/2002 Lee et al.
6,478,239 B2 11/2002 Chung et al.
6,484,489 B1 11/2002 Foust et al.
6,505,089 B1 1/2003 Yang et al.
6,523,350 B1 2/2003 Mancini et al.
6,546,732 B1 4/2003 Young et al.
6,547,163 B1 4/2003 Mansour et al.
6,564,831 B1 5/2003 Sanoner et al.
6,634,175 B1 10/2003 Kawata et al.
6,662,565 B2 12/2003 Brundish et al.
6,672,654 B2 1/2004 Yamada et al.
6,676,892 B2 1/2004 Das et al.
6,692,037 B1 2/2004 Lin
6,705,383 B2 3/2004 Beeck et al.
6,711,898 B2 3/2004 Laing et al.
6,715,292 B1 4/2004 Hoke
6,718,770 B2 4/2004 Laing et al.
6,755,024 B1 6/2004 Mao et al.
6,756,561 B2 6/2004 McGregor et al.
6,796,770 B2 9/2004 Gigas et al.
D498,825 S 11/2004 Fu
6,811,744 B2 11/2004 Keicher et al.
6,834,505 B2 12/2004 Al-Roub et al.
6,865,889 B2 3/2005 Mancini et al.
6,898,938 B2 * 5/2005 Mancini ..... F23D 11/107 60/740
6,915,840 B2 7/2005 Devine, II et al.
6,951,227 B1 10/2005 Su
6,976,363 B2 12/2005 McMasters et al.
6,993,916 B2 2/2006 Johnson et al.
7,007,864 B2 3/2006 Snyder et al.
7,062,920 B2 6/2006 McMasters et al.
7,104,066 B2 9/2006 Leen et al.
7,121,095 B2 10/2006 McMasters et al.
7,144,221 B2 12/2006 Giffin
7,146,725 B2 12/2006 Kottilingam et al.
7,358,457 B2 4/2008 Peng et al.
7,434,313 B2 10/2008 Dasilva et al.
7,455,740 B2 11/2008 Bostanjoglo et al.
7,540,154 B2 6/2009 Tanimura et al.
7,559,202 B2 7/2009 Prociw et al.
7,572,524 B2 8/2009 Sabol et al.
7,654,000 B2 2/2010 Prociw et al.
7,665,306 B2 2/2010 Bronson et al.
7,712,313 B2 5/2010 Kojovic et al.
7,748,221 B2 7/2010 Patel et al.
7,827,800 B2 11/2010 Stastny et al.
7,845,549 B2 12/2010 Budinger
8,061,142 B2 11/2011 Kastrup et al.
8,074,866 B2 12/2011 Bird
8,108,058 B2 1/2012 Murrish et al.
8,256,221 B2 9/2012 Rubio et al.
8,316,541 B2 11/2012 Patel et al.
8,806,871 B2 8/2014 McMasters et al.
10,001,281 B2 * 6/2018 Patel ..... F23R 3/286
2001/0031920 A1 10/2001 Kaufman et al.

(56) References Cited

U.S. PATENT DOCUMENTS

| | | | | |
|---|---|---|---|---|
| 2002/0085941 | A1 | 7/2002 | Deevi et al. | |
| 2002/0125336 | A1 | 9/2002 | Bretz | |
| 2002/0129606 | A1 | 9/2002 | Wrubel et al. | |
| 2002/0152715 | A1 | 10/2002 | Rotheroe | |
| 2003/0105538 | A1 | 6/2003 | Wooten | |
| 2003/0121266 | A1 | 7/2003 | Modi et al. | |
| 2003/0131474 | A1 | 7/2003 | Kastrup et al. | |
| 2004/0062636 | A1 | 4/2004 | Mazzola et al. | |
| 2004/0086635 | A1 | 5/2004 | Grossklaus et al. | |
| 2004/0101022 | A1 | 5/2004 | Hardwicke et al. | |
| 2004/0148937 | A1 | 8/2004 | Mancini et al. | |
| 2004/0200069 | A1 | 10/2004 | Nguyen | |
| 2005/0028526 | A1 | 2/2005 | Von Der Bank | |
| 2005/0047914 | A1 | 3/2005 | Tomberg | |
| 2005/0144954 | A1 | 7/2005 | Lemon et al. | |
| 2005/0204769 | A1 | 9/2005 | Oberley et al. | |
| 2005/0205232 | A1 | 9/2005 | Wang et al. | |
| 2005/0235493 | A1 | 10/2005 | Philip et al. | |
| 2005/0257530 | A1 | 11/2005 | Zupanc et al. | |
| 2005/0262843 | A1 | 12/2005 | Monty | |
| 2005/0265828 | A1 | 12/2005 | Horng et al. | |
| 2005/0271507 | A1 | 12/2005 | Muriithi et al. | |
| 2006/0042083 | A1 | 3/2006 | Baker et al. | |
| 2006/0248898 | A1 | 11/2006 | Buelow et al. | |
| 2007/0017224 | A1 | 1/2007 | Li et al. | |
| 2007/0028595 | A1 | 2/2007 | Mongia et al. | |
| 2007/0028617 | A1 | 2/2007 | Hsieh et al. | |
| 2007/0028618 | A1 | 2/2007 | Hsiao et al. | |
| 2007/0028620 | A1 | 2/2007 | McMasters et al. | |
| 2007/0028624 | A1 | 2/2007 | Hsieh et al. | |
| 2007/0071902 | A1 | 3/2007 | Dietrich et al. | |
| 2007/0084047 | A1 | 4/2007 | Lange et al. | |
| 2007/0084049 | A1 | 4/2007 | Wang et al. | |
| 2007/0098929 | A1 | 5/2007 | Dietrich et al. | |
| 2007/0119177 | A1* | 5/2007 | McMasters ..... | F23R 3/283 60/737 |
| 2007/0141375 | A1 | 6/2007 | Budinger et al. | |
| 2007/0157616 | A1 | 7/2007 | Hernandez et al. | |
| 2007/0163114 | A1 | 7/2007 | Johnson | |
| 2007/0163263 | A1 | 7/2007 | Thomson et al. | |
| 2007/0169486 | A1 | 7/2007 | Hernandez et al. | |
| 2007/0205184 | A1 | 9/2007 | Mazumder et al. | |
| 2007/0207002 | A1 | 9/2007 | Roh | |
| 2007/0227147 | A1 | 10/2007 | Cayre et al. | |
| 2007/0287027 | A1 | 12/2007 | Justin | |
| 2008/0014457 | A1 | 1/2008 | Gennaro et al. | |
| 2008/0078080 | A1 | 4/2008 | Patel et al. | |
| 2008/0110022 | A1 | 5/2008 | Brown et al. | |
| 2008/0178994 | A1 | 7/2008 | Di et al. | |
| 2008/0182017 | A1 | 7/2008 | Singh et al. | |
| 2008/0182107 | A1 | 7/2008 | Lee | |
| 2008/0314878 | A1 | 12/2008 | Cai et al. | |
| 2009/0113893 | A1 | 5/2009 | Li et al. | |
| 2009/0255256 | A1 | 10/2009 | McMasters et al. | |
| 2009/0255264 | A1 | 10/2009 | McMasters et al. | |
| 2009/0256007 | A1 | 10/2009 | McMasters et al. | |
| 2010/0251719 | A1 | 10/2010 | Mancini et al. | |
| 2010/0263382 | A1 | 10/2010 | Mancini et al. | |
| 2010/0307161 | A1 | 12/2010 | Thomson et al. | |
| 2011/0206533 | A1 | 8/2011 | Lee et al. | |
| 2011/0259976 | A1* | 10/2011 | Tyler ..... | F23D 11/386 239/125 |
| 2012/0047903 | A1 | 3/2012 | Williams et al. | |
| 2012/0151930 | A1 | 6/2012 | Patel et al. | |
| 2012/0227408 | A1 | 9/2012 | Buelow et al. | |
| 2012/0228405 | A1 | 9/2012 | Buelow et al. | |
| 2015/0316265 | A1* | 11/2015 | Dolmansley ..... | F23Q 9/00 60/772 |

FOREIGN PATENT DOCUMENTS

| | | | |
|---|---|---|---|
| CN | 102798150 | A | 11/2012 |
| CN | 102997280 | A | 3/2013 |
| CN | 103184899 | A | 7/2013 |
| EP | 0019421 | A2 | 11/1980 |
| EP | 0042454 | A1 | 12/1981 |
| EP | 1413830 | A2 | 4/2004 |
| EP | 1484553 | A2 | 12/2004 |
| EP | 1806536 | A1 | 7/2007 |
| EP | 2009257 | A1 | 12/2008 |
| EP | 2397763 | A1 | 12/2011 |
| FR | 2896303 | A1 | 7/2007 |
| GB | 837500 | A | 6/1960 |
| GB | 2437977 | A | 11/2007 |
| JP | S51-138225 | A | 11/1976 |
| JP | 5575535 | A | 6/1980 |
| JP | 5841471 | U | 3/1983 |
| JP | S60-126521 | A | 7/1985 |
| JP | 62150543 | U | 9/1987 |
| JP | 05-086902 | A | 4/1993 |
| JP | S6-229553 | A | 8/1994 |
| JP | 0714022 | A | 1/1995 |
| JP | H08-285228 | A | 11/1996 |
| JP | 10148334 | A | 6/1998 |
| JP | 2798281 | B2 | 9/1998 |
| JP | 11237047 | A | 8/1999 |
| JP | H11-350978 | A | 12/1999 |
| JP | 2000296561 | A | 10/2000 |
| JP | 2000320836 | A | 11/2000 |
| JP | 2001041454 | A | 2/2001 |
| JP | 2002115847 | A | 4/2002 |
| JP | 2002-520568 | A | 7/2002 |
| JP | 2003106528 | A | 4/2003 |
| JP | 2003129862 | A | 5/2003 |
| JP | 2003515718 | A | 5/2003 |
| JP | 2003214300 | A | 7/2003 |
| JP | 2004168610 | A | 6/2004 |
| JP | 2005076639 | A | 3/2005 |
| JP | 2005106411 | A | 4/2005 |
| JP | 2005337703 | A | 12/2005 |
| JP | 2005344717 | A | 12/2005 |
| JP | 2006524579 | A | 11/2006 |
| JP | 2007046886 | A | 2/2007 |
| JP | 2007-146697 | A | 6/2007 |
| JP | 2007-155318 | A | 6/2007 |
| JP | 2007155318 | A | 6/2007 |
| JP | 2007183093 | A | 7/2007 |
| JP | 3960222 | B2 | 8/2007 |
| JP | 2007-530263 | A | 11/2007 |
| JP | 2008-008612 | A | 1/2008 |
| JP | 2008069449 | A | 3/2008 |
| JP | 2011-520055 | A | 7/2011 |
| JP | 2012-132672 | A | 7/2012 |
| WO | 9855800 | A1 | 12/1998 |
| WO | 2006079459 | A1 | 8/2006 |
| WO | 2009/126701 | A2 | 10/2009 |
| WO | 2009126701 | A2 | 10/2009 |

OTHER PUBLICATIONS

Notification of Reasons for Refusal issued in connection with related JP Application No. 2016-533696 dated Apr. 24, 2017.
Japanese Search Report issued in connection with related JP Application No. 2016-533696 dated Apr. 27, 2017.
First Office Action and Search issued in connection with related CN Application No. 201480065056.3 dated May 24, 2017.
Michael R. Johnson, U.S. Appl. No. 11/332,532, filed Jan. 13, 2006.
Kastrup et al., U.S. Appl. No. 12/120,785, filed May 15, 2008.
McMasters et al., U.S. Appl. No. 12/182,500, filed Jul. 30, 2008.
McMasters et al., U.S. Appl. No. 12/418,875, filed Apr. 6, 2009.
Mcmasters et al., U.S. Appl. No. 61/666,644, filed Jun. 29, 2012.
Benjamin et al., U.S. Appl. No. 61/787,961, filed Mar. 15, 2013.
Mook et al., U.S. Appl. No. 61/799,845, filed Mar. 15, 2013.
McMasters et al., U.S. Appl. No. 14/328,347, filed Jul. 10, 2014.
Barnhart et al., U.S. Appl. No. 15/039,065, filed May 25, 2016.
Mook et al., U.S. Appl. No. 15/107,263, filed Jun. 22, 2016.
International Search Report and Written Opinion dated Feb. 9, 2015 which was issued in connection with PCT Application No. PCT/US2014/072023 which was filed on Dec. 23, 2014.
Unofficial English Translation of Japanese Office Action issued in connection with corresponding JP Application No. 2011504034 dated Aug. 6, 2013.

(56) References Cited

OTHER PUBLICATIONS

U.S. Non-Final Office Action issued in connection with related U.S. Appl. No. 12/412,512 dated Sep. 26, 2013.
Unofficial English Translation of Japanese Notice of Allowance Office Action issued in connection with related JP Application No. 2011504037 dated Oct. 22, 2013.
Unofficial English Translation of Japanese Notice of Allowance Office Action issued in connection with related JP Application No. 2011504035 dated Nov. 12, 2013.
U.S. Notice of Allowance Office Action issued in connection with related U.S. Appl. No. 12/412,512 dated Apr. 30, 2014.
Unofficial English Translation of Japanese Office Action issued in connection with related JP Application No. 2011504059 dated Jun. 3, 2014.
Unofficial English Translation of Japanese Office Action issued in connection with related JP Application No. 2011504034 dated Aug. 5, 2014.
Unofficial English Translation of Japanese Notice of Allowance Office Action issued in connection with related JP Application No. 2011504059 dated Mar. 3, 2015.
Unofficial English Translation of Japanese Notice of Allowance Office Action issued in connection with related JP Application No. 2011504034 dated Jun. 30, 2015.
PCT Invitation to Pay Additional Fees issued in connection with related PCT Application No. PCT/US2014/066966 dated Aug. 20, 2015.
PCT Search Report and Written Opinion issued in connection with related PCT Application No. PCT/US2014/072028 dated Sep. 2, 2015.
PCT Search Report and Written Opinion issued in connection with related PCT Application No. PCT/US2014/66966 dated Oct. 12, 2015.
U.S. Non-Final Office Action issued in connection with related U.S. Appl. No. 14/328,347 dated Oct. 20, 2016.
Liu et al., "RP of Si3 N4 Burner Arrays via Assembly Mould SDM", Rapid Prototyping, vol. No. 10, Issue No. 4, pp. 239-246, 2004.
U.S. Non-Final Office Action issued in connection with related U.S. Appl. No. 12/182,469 dated Feb. 4, 2009.
U.S. Non-Final Office Action issued in connection with related U.S. Appl. No. 11/332,532 dated Mar. 17, 2009.
U.S. Final Office Action issued in connection with related U.S. Appl. No. 11/332,532 dated Aug. 20, 2009.
U.S. Final Office Action issued in connection with related U.S. Appl. No. 12/182,469 dated Nov. 12, 2009.
U.S. Non-Final Office Action issued in connection with related U.S. Appl. No. 12/182,469 dated May 28, 2010.
U.S. Non-Final Office Action issued in connection with related U.S. Appl. No. 11/332,532 dated Feb. 18, 2011.
U.S. Non-Final Office Action issued in connection with related U.S. Appl. No. 12/120,785 dated Apr. 13, 2011.
U.S. Non-Final Office Action issued in connection with related U.S. Appl. No. 12/200,960 dated Apr. 29, 2011.
U.S. Non-Final Office Action issued in connection with related U.S. Appl. No. 12/182,500 dated Jun. 15, 2011.
U.S. Non-Final Office Action issued in connection with related U.S. Appl. No. 12/182,526 dated Jul. 5, 2011.
U.S. Non-Final Office Action issued in connection with related U.S. Appl. No. 12/182,485 dated Jul. 11, 2011.
U.S. Final Office Action issued in connection with related U.S. Appl. No. 12/200,960 dated Aug. 16, 2011.
U.S. Non-Final Office Action issued in connection with related U.S. Appl. No. 12/200,956 dated Sep. 15, 2011.
U.S. Non-Final Office Action issued in connection with related U.S. Appl. No. 12/120,797 dated Nov. 37, 2011.
U.S. Non-Final Office Action issued in connection with related U.S. Appl. No. 12/262,237 dated Nov. 7, 2011.
U.S. Final Office Action issued in connection with related U.S. Appl. No. 11/332,532 dated Nov. 8, 2011.
U.S. Non-Final Office Action issued in connection with related U.S. Appl. No. 12/262,225 dated Jan. 3, 2012.
U.S. Non-Final Office Action issued in connection with related U.S. Appl. No. 12/182,526 dated Jan. 17, 2012.
U.S. Non-Final Office Action issued in connection with related U.S. Appl. No. 12/412,512 dated Jan. 19, 2012.
U.S. Non-Final Office Action issued in connection with related U.S. Appl. No. 12/418,875 dated Jan. 31, 2012.
PCT Invitation to Pay Additional Fees issued in connection with related PCT Application No. PCT/US2009/039085 dated Feb. 6, 2012.
PCT Search Report and Written Opinion issued in connection with related PCT Application No. PCT/US2009/039100 dated Feb. 6, 2012.
PCT Search Report and Written Opinion issued in connection with related PCT Application No. PCT/US2009/037224 dated Feb. 7, 2012.
PCT Search Report and Written Opinion issued in connection with related PCT Application No. PCT/US2009/039894 dated Mar. 8, 2012.
PCT Search Report and Written Opinion issued in connection with related PCT Application No. PCT/US2009/037101 dated Mar. 13, 2012.
U.S. Final Office Action issued in connection with related U.S. Appl. No. 12/262,237 dated Mar. 15, 2012.
PCT Search Report and Written Opinion issued in connection with related PCT Application No. PCT/US2009/037148 dated Mar. 20, 2012.
PCT Search Report and Written Opinion issued in connection with related PCT Application No. PCT/US2009/037221 dated Mar. 20, 2012.
PCT Search Report and Written Opinion issued in connection with related PCT Application No. PCT/US2009/039928 dated Mar. 27, 2012.
U.S. Non-Final Office Action issued in connection with related U.S. Appl. No. 11/332,532 dated Apr. 6, 2012.
U.S. Final Office Action issued in connection with related U.S. Appl. No. 12/412,512 dated May 23, 2012.
U.S. Non-Final Office Action issued in connection with related U.S. Appl. No. 12/412,523 dated May 24, 2012.
U.S. Final Office Action issued in connection with related U.S. Appl. No. 12/418,875 dated May 25, 2012.
PCT Invitation to Pay Additional Fees issued in connection with related PCT Application No. PCT/US2009/039385 dated Jun. 6, 2012.
U.S. Non-Final Office Action issued in connection with related U.S. Appl. No. 12/418,889 dated Jun. 13, 2012.
U.S. Non-Final Office Action issued in connection with related U.S. Appl. No. 12/418,901 dated Jun. 18, 2012.
U.S. Final Office Action issued in connection with related U.S. Appl. No. 12/262,225 dated Jun. 29, 2012.
PCT Search Report and Written Opinion issued in connection with related PCT Application No. PCT/US2009/039085 dated Jul. 3, 2012.
U.S. Final Office Action issued in connection with related U.S. Appl. No. 12/120,797 dated Jul. 23, 2012.
U.S. Final Office Action issued in connection with related U.S. Appl. No. 12/182,526 dated Jul. 24, 2012.
U.S. Final Office Action issued in connection with related U.S. Appl. No. 11/332,532 dated Aug. 3, 2012.
U.S. Non-Final Office Action issued in connection with related U.S. Appl. No. 12/200,960 dated Aug. 13, 2012.
PCT Search Report and Written Opinion issued in connection with related PCT Application No. PCT/US2009/39385 dated Nov. 22, 2012.
U.S. Non-Final Office Action issued in connection with related U.S. Appl. No. 11/332,532 dated Jan. 3, 2013.
Unofficial English Translation of Japanese Office Action issued in connection with related JP Application No. 2011504037 dated Mar. 26, 2013.
Unofficial English Translation of Japanese Office Action issued in connection with related JP Application No. 2011504035 dated Apr. 2, 2013.

(56) References Cited

OTHER PUBLICATIONS

Unofficial English Translation of Japanese Office Action issued in connection with related JP Application No. 2011504038 dated Apr. 2, 2013.
U.S. Final Office Action issued in connection with related U.S. Appl. No. 11/332,532 dated Apr. 29, 2013.
Unofficial English Translation of Japanese Office Action issued in connection with related JP Application No. 2011504059 dated May 28, 2013.
Office Action issued in connection with corresponding EP Application No. 14879262.5 dated Oct. 26, 2017.
McMasters, M.A et al., Gas turbine engine components and their methods of manufacture and repair, GE Pending U.S. Appl. No. 61/044,116, filed Apr. 11, 2008.
McMasters, M., et al., Fuel nozzle assembly and method of fabricating the same, GE Pending U.S. Appl. No. 31/666,644, filed Jun. 29, 2012.
Benjamin, M. A., et al., Gas turbine engine injector monolithic fuel nozzle tip, GE Pending U.S. Appl. No. 61/787,961, filed Mar. 15, 2013.
Mook, M.T., et al., Gas turbine engine fuel injector monolithic fuel nozzle tip section, GE Pending U.S. Appl. No. 61/799,845, filed Mar. 15, 2013.
Barnhart, D.R., Fuel nozzle with fluid lock and purge appartus, GE Pending U.S. Appl. No. 61/909,646, filed Nov. 27, 2013.
Mook, J. T., et al., Fuel nozzle with flexible support structures, GE Pending U.S. Appl. No. 61/920,018, filed Dec. 23, 2013.
Machine Translation and Copy of Notification of Reasons for Refusal issued in connection with corresponding JP Application No. 2016-540592 dated Oct. 9, 2018.

* cited by examiner

FUEL NOZZLE STRUCTURE FOR AIR ASSIST INJECTION

CROSS-REFERENCE TO RELATED APPLICATIONS

This application is a national stage application under 35 U.S.C. § 371(c) of prior filed, co-pending PCT application serial number PCT/US2014/072023, filed on Dec. 23, 2014 which claims priority to U.S. provisional patent application 61/920,002, titled "FUEL NOZZLE STRUCTURE FOR AIR ASSIST INJECTION", filed on Dec. 23, 2013. The above-listed applications are herein incorporated by reference.

BACKGROUND

Embodiments of the present invention relate to gas turbine engine fuel nozzles and, more particularly, to an apparatus for draining and purging gas turbine engine fuel nozzles.

Aircraft gas turbine engines include a combustor in which fuel is burned to input heat to the engine cycle. Typical combustors incorporate one or more fuel injectors whose function is to introduce liquid fuel into an air flow stream so that it can atomize and burn.

Staged combustors have been developed to operate with low pollution, high efficiency, low cost, high engine output, and good engine operability. In a staged combustor, the nozzles of the combustor are operable to selectively inject fuel through two or more discrete stages, each stage being defined by individual fuel flowpaths within the fuel nozzle. For example, the fuel nozzle may include a pilot stage that operates continuously, and a main stage that only operates at higher engine power levels. The fuel flowrate may also be variable within each of the stages.

The main stage includes an annular main injection ring having a plurality of fuel injection ports which discharge fuel through a surrounding centerbody into a swirling mixer airstream. A need with this type of fuel nozzle is to make sure that fuel is not ingested into voids within the fuel nozzle where it could ignite causing internal damage and possibly erratic operation.

BRIEF DESCRIPTION

This need is addressed by the embodiments of the present invention, which provide a fuel nozzle incorporating an injection structure configured to generate an airflow that purges and assists penetration of a fuel stream into a high velocity airstream.

According to one aspect of the invention, a fuel nozzle apparatus for a gas turbine engine includes: an annular outer body, the outer body extending parallel to a centerline axis, the outer body having a generally cylindrical exterior surface extending between forward and aft ends, and having a plurality of openings passing through the exterior surface; an annular inner body disposed inside the outer body, cooperating with the outer body to define an annular space; an annular main injection ring disposed inside the annular space, the main injection ring including an annular array of fuel posts extending radially outward therefrom; each fuel post being aligned with one of the openings in the outer body and separated from the opening by a perimeter gap which communicates with the annular space; a main fuel gallery extending within the main injection ring in a circumferential direction; and a plurality of main fuel orifices, each main fuel orifice communicating with the main fuel gallery and extending through one of the fuel posts.

According to another aspect of the invention, each opening communicates with a conical well inlet formed on an inner surface of the outer body; and each fuel post is frustoconical in shape and includes a conical lateral surface and a planar, radially-facing outer surface, wherein the perimeter gap is defined between the well inlet and the lateral surface.

According to another aspect of the invention, each fuel post includes a perimeter wall defining a cylindrical lateral surface and a radially-outward-facing floor recessed radially inward from a distal end surface of the perimeter wall to define a spray well; and the perimeter gap is defined between the opening and the lateral surface.

According to another aspect of the invention, the fuel post extends radially outward beyond an outer surface of the outer body.

According to another aspect of the invention, a concave fillet is disposed at a junction of the fuel post and the main injection ring.

According to another aspect of the invention, a convex-curved fillet is formed in the outer body adjoining the opening.

According to another aspect of the invention, an assist port is formed in the perimeter wall near an intersection of the perimeter wall with the floor.

According to another aspect of the invention, each fuel post is elongated in plan view and includes a perimeter wall defining a lateral surface and a radially-outward-facing floor recessed radially inward from a distal end surface of the perimeter wall to define a spray well; and the perimeter gap is defined between the opening and the lateral surface.

According to another aspect of the invention, at least one of the fuel posts incorporates a ramp-shaped scarf extending along a line parallel to the distal end surface, the scarf having a maximum radial depth at the spray well and tapering outward in radial height, joining the distal end surface at a distance away from the spray well.

According to another aspect of the invention, the perimeter wall of each fuel post is racetrack-shaped in plan view.

According to another aspect of the invention, the apparatus further includes: an annular venturi including a throat of minimum diameter disposed inside the inner body; an annular splitter disposed inside the venturi; an array of outer swirl vanes extending between the venturi and the splitter; a pilot fuel injector disposed within the splitter; and an array of inner swirl vanes extending between the splitter and the pilot fuel injector.

According to another aspect of the invention, the apparatus further includes: a fuel system operable to supply a flow of liquid fuel at varying flowrates; a pilot fuel conduit coupled between the fuel system and the pilot fuel injector; and a main fuel conduit coupled between the fuel system and the main injection ring.

BRIEF DESCRIPTION OF THE DRAWINGS

Embodiments of the present invention may be best understood by reference to the following description, taken in conjunction with the accompanying drawing figures in which.

DETAILED DESCRIPTION

Generally, embodiments of the present invention provide a fuel nozzle with an injection ring. The main injection ring incorporates an injection structure configured to generate an airflow through a controlled gap surrounding a fuel orifice that flows fuel from the main injection ring, and assists penetration of a fuel stream from the fuel orifice into a high velocity airstream.

Figure 1:
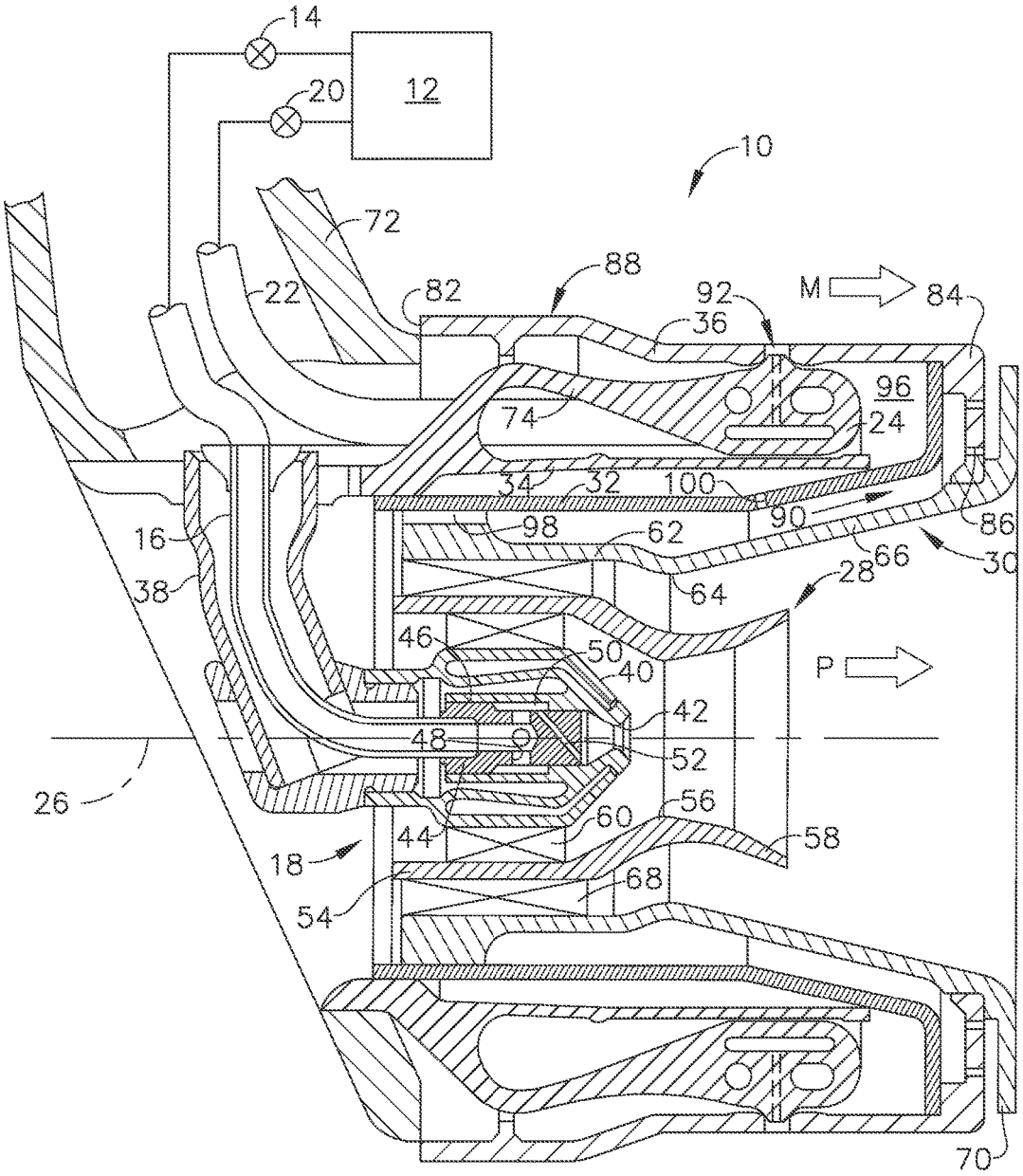
FIG. 1 is a schematic cross-sectional view of a gas turbine engine fuel nozzle constructed according to an aspect of the present invention.

Now, referring to the drawings wherein identical reference numerals denote the same elements throughout the various views, FIG. 1 depicts an exemplary of a fuel nozzle 10 of a type configured to inject liquid hydrocarbon fuel into an airflow stream of a gas turbine engine combustor (not shown). The fuel nozzle 10 is of a "staged" type meaning it is operable to selectively inject fuel through two or more discrete stages, each stage being defined by individual fuel flowpaths within the fuel nozzle 10. The fuel flowrate may also be variable within each of the stages.

The fuel nozzle 10 is connected to a fuel system 12 of a known type, operable to supply a flow of liquid fuel at varying flowrates according to operational need. The fuel system supplies fuel to a pilot control valve 14 which is coupled to a pilot fuel conduit 16, which in turn supplies fuel to a pilot 18 of the fuel nozzle 10. The fuel system 12 also supplies fuel to a main valve 20 which is coupled to a main fuel conduit 22, which in turn supplies a main injection ring 24 of the fuel nozzle 10.

For purposes of description, reference will be made to a centerline axis 26 of the fuel nozzle 10 which is generally parallel to a centerline axis of the engine (not shown) in which the fuel nozzle 10 would be used. The major components of the illustrated fuel nozzle 10 are disposed extending parallel to and surrounding the centerline axis 26, generally as a series of concentric rings. Starting from the centerline axis 26 and proceeding radially outward, the major components are: the pilot 18, a splitter 28, a venturi 30, an inner body 32, a main ring support 34, the main injection ring 24, and an outer body 36. Each of these structures will be described in detail.

The pilot 18 is disposed at an upstream end of the fuel nozzle 10, aligned with the centerline axis 26 and surrounded by a fairing 38.

The illustrated pilot 18 includes a generally cylindrical, axially-elongated, pilot centerbody 40. An upstream end of the pilot centerbody 40 is connected to the fairing 38. The downstream end of the pilot centerbody 40 includes a converging-diverging discharge orifice 42 with a conical exit.

A metering plug 44 is disposed within a central bore 46 of the pilot centerbody 40 The metering plug 44 communicates with the pilot fuel conduit. The metering plug 44 includes transfer holes 48 that flow fuel to a feed annulus 50 defined between the metering plug 44 and the central bore 46, and also includes an array of angled spray holes 52 arranged to receive fuel from the feed annulus 50 and flow it towards the discharge orifice 42 in a swirling pattern, with a tangential velocity component.

The annular splitter 28 surrounds the pilot injector 18. It includes, in axial sequence: a generally cylindrical upstream section 54, a throat 56 of minimum diameter, and a downstream diverging section 58.

An inner air swirler includes a radial array of inner swirl vanes 60 which extend between the pilot centerbody 40 and the upstream section 54 of the splitter 28. The inner swirl vanes 60 are shaped and oriented to induce a swirl into air flow passing through the inner air swirler.

The annular venturi 30 surrounds the splitter 28. It includes, in axial sequence: a generally cylindrical upstream section 62, a throat 64 of minimum diameter, and a downstream diverging section 66. A radial array of outer swirl vanes 68 defining an outer air swirler extends between the splitter 28 and the venturi 30. The outer swirl vanes 68, splitter 28, and inner swirl vanes 60 physically support the pilot 18. The outer swirl vanes 68 are shaped and oriented to induce a swirl into air flow passing through the outer air swirler. The bore of the venturi 30 defines a flowpath for a pilot air flow, generally designated "P", through the fuel nozzle 10. A heat shield 70 in the form of an annular, radially-extending plate may be disposed at an aft end of the diverging section 66. A thermal barrier coating (TBC) (not shown) of a known type may be applied on the surface of the heat shield 70 and/or the diverging section 66.

The annular inner body 32 surrounds the venturi 30 and serves as a radiant heat shield as well as other functions described below.

The annular main ring support 34 surrounds the inner body 32. The main ring support 34 may be connected to the fairing 38 and serve as a mechanical connection between the main injection ring 24 and stationary mounting structure such as a fuel nozzle stem, a portion of which is shown as item 72.

The main injection ring 24 which is annular in form surrounds the venturi 30. It may be connected to the main ring support 34 by one or more main support arms 74.

The main injection ring 24 includes a main fuel gallery 76 extending in a circumferential direction (see FIG. 2) which is coupled to and supplied with fuel by the main fuel conduit 22. A radial array of main fuel orifices 78 formed in the main injection ring 24 communicate with the main fuel gallery 76. During engine operation, fuel is discharged through the main fuel orifices 78. Running through the main injection ring 24 closely adjacent to the main fuel gallery 76 are one or more pilot fuel galleries 80. During engine operation, fuel constantly circulates through the pilot fuel galleries 80 to cool the main injection ring 24 and prevent coking of the main fuel gallery 76 and the main fuel orifices 78.

The annular outer body 36 surrounds the main injection ring 24, venturi 30, and pilot 18, and defines the outer extent of the fuel nozzle 10. A forward end 82 of the outer body 36 is joined to the stem 72 when assembled (see FIG. 1). An aft end of the outer body 36 may include an annular, radially-extending baffle 84 incorporating cooling holes 86 directed at the heat shield 70. Extending between the forward and aft ends is a generally cylindrical exterior surface 88 which in operation is exposed to a mixer airflow, generally designated "M." The outer body 36 defines a secondary flowpath 90, in cooperation with the venturi 30 and the inner body 32. Air passing through this secondary flowpath 90 is discharged through the cooling holes 86.

The outer body 36 includes an annular array of recesses referred to as "spray wells" 92. Each of the spray wells 92 is defined by an opening 94 in the outer body 36 in cooperation with the main injection ring 24. Each of the main fuel orifices 78 is aligned with one of the spray wells 92.

The outer body 36 and the inner body 32 cooperate to define an annular tertiary space or void 96 protected from the surrounding, external air flow. The main injection ring 24 is contained in this void. Within the fuel nozzle 10, a flowpath is provided for the tip air stream to communicate with and supply the void 96 a minimal flow needed to maintain a small pressure margin above the external pressure at locations near the spray wells 92. In the illustrated example, this flow is provided by small supply slots 98 and supply holes 100 disposed in the venturi 30 and the inner body 32, respectively.

The fuel nozzle 10 and its constituent components may be constructed from one or more metallic alloys. Nonlimiting examples of suitable alloys include nickel and cobalt-based alloys.

All or part of the fuel nozzle 10 or portions thereof may be part of a single unitary, one-piece, or monolithic component, and may be manufactured using a manufacturing process which involves layer-by-layer construction or additive fabrication (as opposed to material removal as with conventional machining processes). Such processes may be referred to as "rapid manufacturing processes" and/or "additive manufacturing processes," with the term "additive manufacturing process" being the term used herein to refer generally to such processes. Additive manufacturing processes include, but are not limited to: Direct Metal Laser Melting (DMLM), Laser Net Shape Manufacturing (LNSM), electron beam sintering, Selective Laser Sintering (SLS), 3D printing, such as by inkjets and laserjets, Sterolithography (SLS), Electron Beam Melting (EBM), Laser Engineered Net Shaping (LENS), and Direct Metal Deposition (DMD).

Figure 3:
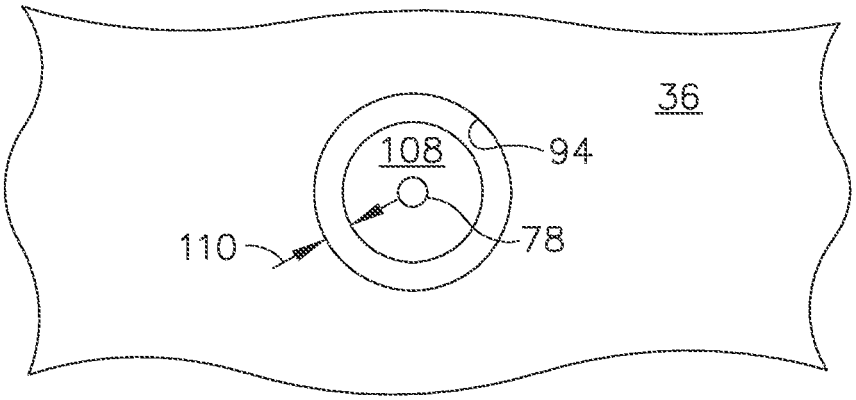
FIG. 3 is a top plan view of the fuel injection structure shown in FIG. 2.
Figure 2:
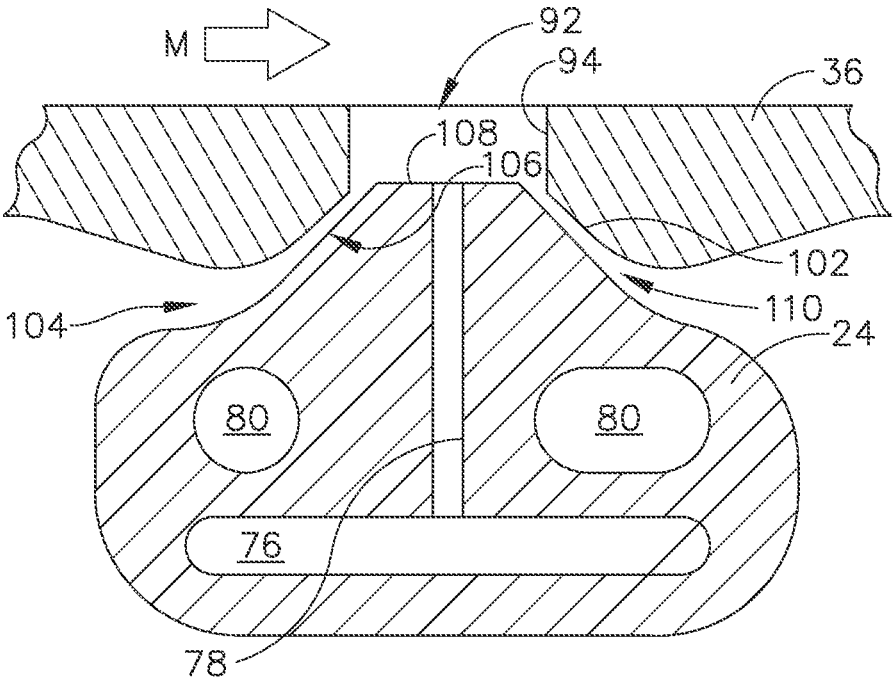
FIG. 2 is an enlarged view of a portion of the fuel nozzle of FIG. 1, showing a main fuel injection structure thereof.

The main injection ring 24, main fuel orifices 78, and spray wells 92 may be configured to provide a controlled secondary purge air path and an air assist at the main fuel orifices 78. Referring to FIGS. 2 and 3, the openings 94 are generally cylindrical and oriented in a radial direction. Each opening 94 communicates with a conical well inlet 102 formed in the wall of the outer body 36. As shown in FIG. 3, the local wall thickness of the outer body 36 adjacent the openings 94 may be increased to provide thickness to define the well inlet 102.

The main injection ring 24 includes a plurality of raised fuel posts 104 extending radially outward therefrom. The fuel posts 104 are frustoconical in shape and include a conical lateral surface 106 and a planar, radially-facing outer surface 108. Each fuel post 104 is aligned with one of the openings 94. Together, the opening 94 and the associated fuel post 104 define one of the spray wells 92. The fuel post 104 is positioned to define an annular gap 110 in cooperation with the associated conical well inlet 102. One of the main fuel orifices 78 passes through each of the fuel posts 104, exiting through the outer surface 108.

These small controlled gaps 110 around the fuel posts 104 serve two purposes. First, the narrow passages permit minimal purge air to flow through to protect the internal tip space or void 96 from fuel ingress. Second, the air flow exiting the gaps 110 provides an air-assist to facilitate penetration of fuel flowing from the main fuel orifices 78 through the spray wells 92 and into the local, high velocity mixer airstream M.

Figure 5:
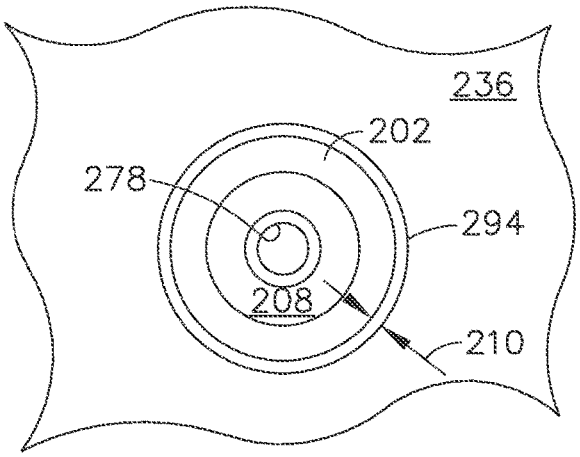
FIG. 5 is a top plan view of the fuel injection structure shown in FIG. 4.
Figure 4:
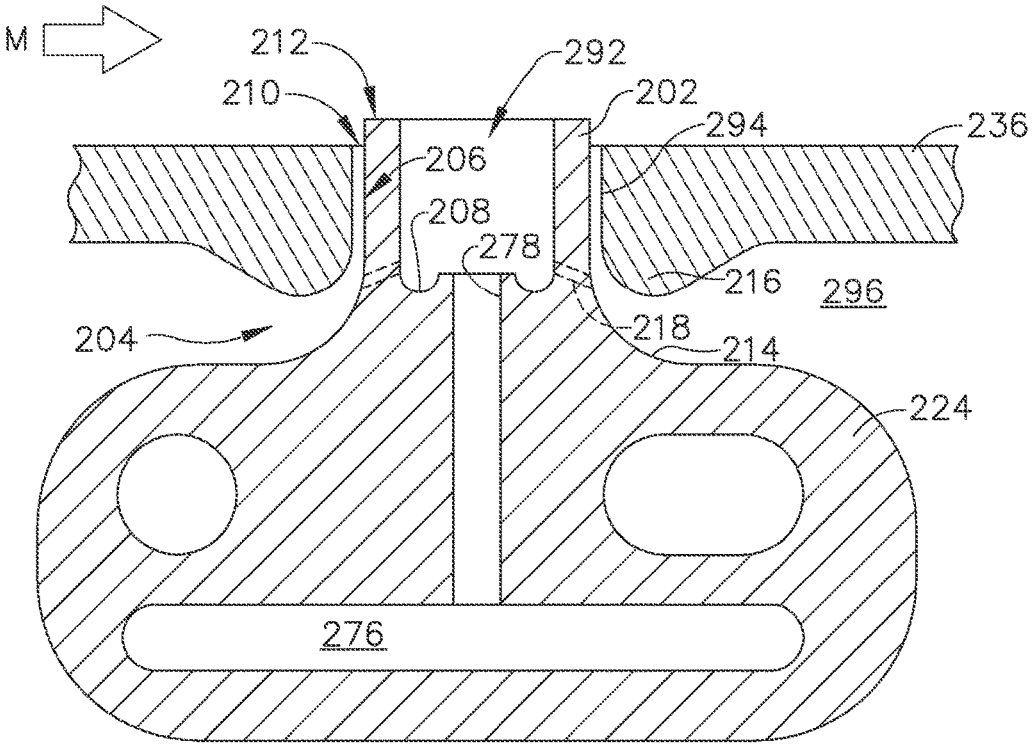
FIG. 4 is a sectional view of a portion of a fuel nozzle, showing an alternative main fuel injection structure.

FIGS. 4 and 5 illustrate an alternative configuration for providing controlled purge air exit and injection air assist. Specifically, these figures illustrate a portion of a main injection ring 224 and an outer body 236 which may be substituted for the main injection ring 24 and outer body 36 described above. Any structures or features of the main injection ring 224 and the outer body 236 that are not specifically described herein may be assumed to be identical to the main injection ring 24 and outer body 36 described above. The outer body 236 includes an annular array of openings 294 which are generally cylindrical and oriented in a radial direction.

The main injection ring 224 includes a plurality of raised fuel posts 204 extending radially outward therefrom. The fuel posts 204 include a perimeter wall 202 defining a cylindrical lateral surface 206. A radially-facing floor 208 is recessed from a distal end surface 212 of the perimeter wall 202, and in combination with the perimeter wall 202, defines a spray well 292. Each of the main fuel orifices 278 communicates with a main fuel gallery 276 and passes through one of the fuel posts 204, exiting through the floor 208 of the fuel post 204. Each fuel post 204 is aligned with one of the openings 294 and is positioned to define an annular gap 210 in cooperation with the associated opening 294. These small controlled gaps 210 around the fuel posts 204 permit minimal purge air to flow through to protect internal tip space or void 296 from fuel ingress. The base 214 of the fuel post 204 may be configured with an annular concave fillet, and the wall of the outer body 236 may include an annular convex-curved fillet 216 at the opening 294. By providing smooth turning and area reduction of the inlet passage this configuration promotes even distribution and maximum attainable velocity of purge airflow through the annular gap 210.

One or more small-diameter assist ports 218 are formed through the perimeter wall 202 of each fuel post 204 near its intersection with the floor 208 of the main injection ring 224. Air flow passing through the assist ports 218 provides an air-assist to facilitate penetration of fuel flowing from the main fuel orifices 278 through the spray wells 292 and into the local, high velocity mixer airstream M.

Figure 7:
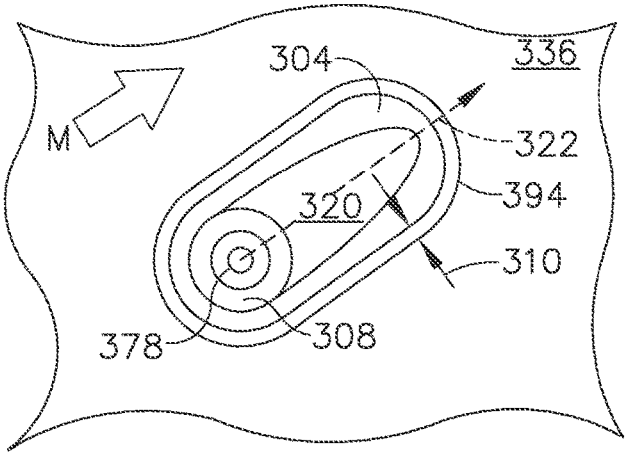
FIG. 7 is a top plan view of the fuel injection structure shown in FIG. 6.
Figure 6:
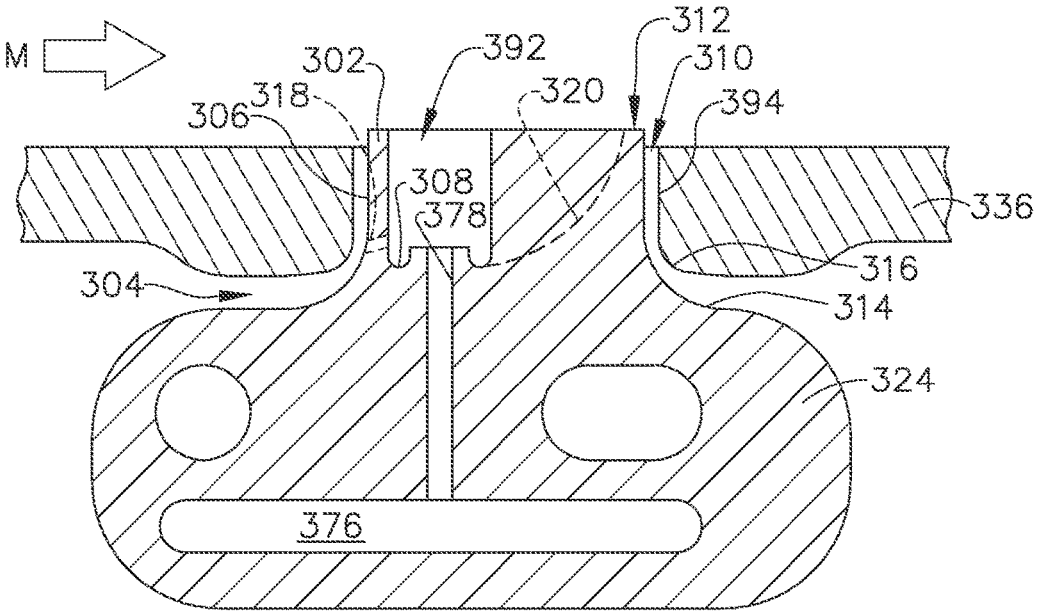
FIG. 6 is a sectional view of a portion of a fuel nozzle, showing an alternative main fuel injection structure.

FIGS. 6 and 7 illustrate another alternative configuration for providing controlled purge air exit and injection air assist. Specifically, these figures illustrate a portion of a main injection ring 324 and an outer body 336 which may be substituted for the main injection ring 24 and outer body 36 described above. Any structures or features of the main injection ring 324 and the outer body 336 that are not specifically described herein may be assumed to be identical to the main injection ring 24 and outer body 36 described above. The outer body 336 includes an annular array of openings 394 which are generally elongated in plan view. They may be oval, elliptical, or another elongated shape. In the specific example illustrated they are "racetrack-shaped". As used herein the term "racetrack-shaped" means a shape including two straight parallel sides connected by semi-circular ends.

The main injection ring 324 includes a plurality of raised fuel posts 304 extending radially outward therefrom. The fuel posts 304 include a perimeter wall 302 defining a lateral surface 306. In plan view the fuel posts 304 are elongated and may be, for example, oval, elliptical, or racetrack-shaped as illustrated. A circular bore is formed in the fuel post 304, defining a floor 308 recessed from a distal end surface 312 of the perimeter wall 302, and in combination with the perimeter wall 302, defines a spray well 392. Each of the main fuel orifices 378 communicates with a main fuel gallery 376 and passes through one of the fuel posts 304, exiting through the floor 308 of the fuel post 304. Each fuel post 304 is aligned with one of the openings 394 and is positioned to define a perimeter gap 310 in cooperation with the associated opening 394. These small controlled gaps 310 around the fuel posts 304 permit minimal purge air to flow through to protect internal tip space from fuel ingress. The base 314 of the fuel post 304 may be configured with an annular concave fillet, and the wall of the outer body 336 may include a thickened portion 316 which may be shaped into a convex-curved fillet at the opening 394. by providing smooth turning and area reduction of the inlet passage this configuration promotes even distribution and high velocity of purge airflow through the perimeter gap 310.

One or more small-diameter assist ports 318 are formed through the perimeter wall 302 of each fuel post 304 near its intersection with the floor 308 of the main injection ring 324. Air flow passing through the assist ports 318 provides an air-assist to facilitate penetration of fuel flowing from the main fuel ports 378 through the spray wells 392 and into the local, high velocity mixer airstream M.

The elongated shape of the fuel posts 304 provides surface area so that the distal end surface 312 of one or more of the fuel posts 304 can be configured to incorporate a ramp-shaped "scarf." The scarfs can be arranged to generate local static pressure differences between adjacent main fuel orifices 378. These local static pressure differences between adjacent main fuel orifices 378 may be used to purge stagnant main fuel from the main injection ring 324 during periods of pilot-only operation as to avoid main circuit coking.

When viewed in cross-section as seen in FIG. 6, the scarf 320 has its greatest or maximum radial depth (measured relative to the distal end surface 312) at its interface with the associated spray well 392 and ramps or tapers outward in radial height, joining the distal end surface 312 at some distance away from the spray well 392. In plan view, as seen in FIG. 7, the scarf 320 extends away from the main fuel port 378 along a line 322 parallel to the distal end surface 312 and tapers in lateral width to a minimum width at its distal end. The direction that the line 322 extends defines the orientation of the scarf 320. The scarf 320 shown in FIG. 7 is referred to as a "downstream" scarf, as it is parallel to a streamline of the rotating or swirling mixer airflow M and has its distal end located downstream from the associated main fuel orifice 378 relative to the mixer airflow M.

The presence or absence of the scarf 320 and orientation of the scarf 320 determines the static air pressure present at the associated main fuel orifice 378 during engine operation. The mixer airflow M exhibits "swirl," that is, its velocity has both axial and tangential components relative to the centerline axis 26. To achieve the purge function mentioned above, the spray wells 392 may be arranged such that different ones of the main fuel orifices 378 are exposed to different static pressures during engine operation. For example, each of the main fuel orifices 378 not associated with a scarf 320 would be exposed to the generally prevailing static pressure in the mixer airflow M. For purposes of description these are referred to herein as "neutral pressure ports." Each of the main fuel orifices 378 associated with a "downstream" scarf 320 as seen in FIG. 7 would be exposed to reduced static pressure relative to the prevailing static pressure in the mixer airflow M. For purposes of description these are referred to herein as "low pressure ports." While not shown, it is also possible that one or more scarfs 320 could be oriented opposite to the orientation of the downstream scarfs 320. These would be "upstream scarfs" and the associated main fuel orifices 378 would be exposed to increased static pressure relative to the prevailing static pressure in the mixer airflow M. For purposes of description these are referred to herein as "high pressure ports."

The main fuel orifices 378 and scarfs 320 may be arranged in any configuration that will generate a pressure differential effective to drive a purging function. For example, positive pressure ports could alternate with neutral pressure ports, or positive pressure ports could alternate with negative pressure ports.

The embodiments of the present invention described above may have several benefits. The embodiments provide a means to prevent voids within a fuel nozzle from ingesting fuel and to assist fuel penetration into an airstream.

The foregoing has described a main injection structure for a gas turbine engine fuel nozzle. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A fuel nozzle apparatus, comprising:

an annular outer body, the outer body extending parallel to a centerline axis, the outer body having a generally cylindrical exterior surface extending between forward and aft ends, and having a plurality of openings passing through the exterior surface;

an annular inner body disposed inside the outer body, cooperating with the outer body to define an annular space;

an annular main injection ring disposed inside the annular space, the main injection ring including an annular array of fuel posts extending radially outward therefrom;

each fuel post being aligned with one of the openings in the outer body and separated from the opening by a perimeter gap which communicates with the annular space, wherein:

each fuel post is elongated in plan view and includes a perimeter wall defining a lateral surface and a radially-outward-facing floor recessed radially inward from a distal end surface of the perimeter wall to define a spray well; and the perimeter gap is defined between the opening and the lateral surface;

a main fuel gallery extending within the main injection ring in a circumferential direction; and a plurality of main fuel orifices, each main fuel orifice communicating with the main fuel gallery and extending through one of the fuel posts.

2. The apparatus of claim 1, wherein a concave fillet is disposed at the junction of the fuel post and the main injection ring.

3. The apparatus of claim 1, wherein a convex-curved fillet is formed in the outer body adjoining the opening.

4. The apparatus of claim 1, wherein an assist port is formed in the perimeter wall near an intersection of the perimeter wall with the floor.

5. The apparatus of claim 1 wherein at least one of the fuel posts incorporates a ramp-shaped scarf extending along a line parallel to the distal end surface, the scarf having a maximum radial depth at the spray well and tapering outward in radial height, joining the distal end surface at a distance away from the spray well.

6. The apparatus of claim 1, wherein the perimeter wall of each fuel post is racetrack-shaped in plan view.

7. The apparatus of claim 1 further including:

an annular venturi including a throat of minimum diameter disposed inside the inner body;

an annular splitter disposed inside the venturi;

an array of outer swirl vanes extending between the venturi and the splitter;

a pilot fuel injector disposed within the splitter; and an array of inner swirl vanes extending between the splitter and the pilot fuel injector.

8. The apparatus of claim 1 further comprising:

a fuel system operable to supply a flow of liquid fuel at varying flowrates;

a pilot fuel conduit coupled between the fuel system and the pilot fuel injector; and a main fuel conduit coupled between the fuel system and the main injection ring.

* * * * *